US006672537B1

(12) United States Patent
Deckard et al.

(10) Patent No.: US 6,672,537 B1
(45) Date of Patent: Jan. 6, 2004

(54) ONE-PIECE WRAP AROUND FIN

(75) Inventors: Dennis D. Deckard, Bedford, IN (US); David J. Mulinix, Bloomington, IN (US); Douglas E. Stark, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/222,491

(22) Filed: Aug. 14, 2002

(51) Int. Cl.[7] ..... F42B 10/14; F42B 10/16
(52) U.S. Cl. ..... 244/3.29; 244/3.24; 244/3.25
(58) Field of Search ..... 244/3.29, 3.1, 244/3.23, 3.24, 3.25, 3.26, 3.27

(56) References Cited

U.S. PATENT DOCUMENTS

| | | | | | |
|---|---|---|---|---|---|
| 17,407 | A | * | 5/1857 | Sibley | 244/3.29 |
| 279,964 | A | * | 6/1883 | Mefford | 244/3.23 |
| 2,597,703 | A | * | 5/1952 | Busacker | 244/3.25 |
| 2,771,842 | A | * | 11/1956 | Hillmer | 244/3.25 |
| 2,835,199 | A | * | 5/1958 | Stanly | 244/3.25 |
| 3,964,696 | A | * | 6/1976 | Orzechowski et al. | 244/3.23 |
| 4,003,576 | A | * | 1/1977 | Carella | 473/586 |
| 4,158,447 | A | * | 6/1979 | Humphries et al. | 244/3.27 |
| 4,350,315 | A | * | 9/1982 | Pollin | 244/3.23 |
| 4,436,259 | A | * | 3/1984 | Schmidt et al. | 244/165 |
| 4,674,405 | A | * | 6/1987 | Brede et al. | 102/202 |
| 4,739,843 | A | | 4/1988 | Burton | |
| 4,896,845 | A | * | 1/1990 | Peretti et al. | 244/3.1 |
| 5,078,337 | A | | 1/1992 | Waller | |
| 5,163,825 | A | | 11/1992 | Oettig | |
| 5,798,479 | A | * | 8/1998 | Bonamy | 102/529 |
| 6,234,082 | B1 | | 5/2001 | Cros et al. | |
| 6,371,684 | B2 | * | 4/2002 | Giesenberg et al. | 403/338 |

* cited by examiner

*Primary Examiner*—Charles T. Jordan
*Assistant Examiner*—Stephen Holzen
(74) *Attorney, Agent, or Firm*—Mark O. Glut

(57) ABSTRACT

A one-piece wrap around fin for a projectile which includes a main portion, a first end and a second end. The main portion has at least one flap. The first end and the second end cooperate such that the fin is circumferentially mountable around the projectile.

15 Claims, 7 Drawing Sheets

ONE-PIECE WRAP AROUND FIN

STATEMENT OF GOVERNMENT INTEREST

The invention described herein may be manufactured and used by or for the Government of the United States of America for governmental purposes without payment of any royalties thereon or therefor.

BACKGROUND

The present invention relates to a one-piece wrap around fin for a projectile. More specifically, but without limitation, the present invention relates to a one-piece wrap around fin for an aerodynamically stabilized kinematic infrared countermeasure or a kinematic flare.

A fin is typically defined, but without limitation, as a fixed or adjustable vane or airfoil affixed longitudinally to an aerodynamically, hydrodynamically, or ballistically designed body for stabilizing purposes. Fins can be, but without limitation, wing-like or paddle-like, and be approximately parallel to the plane of symmetry of the body to afford directional stability.

Flares are used for a variety of applications, including, but not limited to, illumination, signaling, marking, decoys, military countermeasures, and the like. A flare is typically defined, but without limitation, as a pyrotechnic device designed to produce a luminous signal or illumination.

In today's combat environment, some missiles are using the forward motion of an aircraft to discriminate between the signature of an aircraft and the signature of a decoy flare. A decoy flare is typically used to attract attention and draw enemy action (i.e. a missile) away from the real target or military operation (i.e. an aircraft.) Often standard decoy flares do not effectively draw enemy action and put the aircraft in danger of being hit by this type of missile. Aerodynamically stabilized kinematic infrared countermeasures or kinematic flares capable of keeping up with the speed of an aircraft are being developed to address this problem. Fins are required to orient and stabilize such a countermeasure or flare in order to maintain a proper trajectory and signature.

There are many known fin arrangements, many of which include deployable rigid fin members. Rigid fins are typically defined as non-pliant, stiff, unyielding, or not flexible fins. These types of arrangements, which employ rigid fins, tend to be too complex and occupy too large of a volume to be useful on many projectiles, specifically on aerodynamically stabilized kinematic infrared countermeasures or kinematic flares. Therefore, a fin with a spring or elastic characteristic is best suited on these types of projectiles.

Past known methods of fin attachments have required welding or physically attaching the fin to the projectile using screws, rivets, pins, or the like. Welding adds cost to the projectile assembly, increases the thickness profile of the projectile assembly, as well as potentially destroying the spring characteristic of the fin. Attachment of the fin by pins, screws, or rivets can affect the integrity of the projectile. In addition, the strength of the fin will be affected by the addition of holes.

For the foregoing reasons, there is a need for a one-piece wrap around fin.

SUMMARY

The instant invention is directed to a one-piece wrap around fin that satisfies the needs enumerated above and below.

The present invention is directed to a one-piece wrap around fin. The one-piece wrap around fin includes a main portion with at least one flap, a first end and a second end. The first end and the second end cooperate such that the fin is circumferentially mountable around a projectile.

It is an object of the invention to provide a one-piece wrap around fin that can orient and stabilize a projectile, countermeasure, or flare.

It is an object of the invention to provide a one-piece wrap around fin that is not too complex and does not occupy too large of a volume.

It is an object of the invention to provide a one-piece wrap around fin that is inexpensive to produce and easy to use.

It is an object of the invention to provide a one-piece wrap around fin that does not affect the integrity, thickness, or characteristics of a projectile, countermeasure, or flare.

It is an object of the invention to provide a one-piece wrap around fin that has no welds, screws, rivets, pins, or any similar type fastener.

It is an object of the invention to provide a one-piece wrap around fin that is one piece, easy to assemble, and requires no complex assembly tooling.

DRAWINGS

These and other features, aspects and advantages of the present invention will become better understood with reference to the following description and appended claims, and accompanying drawings wherein:

DESCRIPTION

Figure 1:
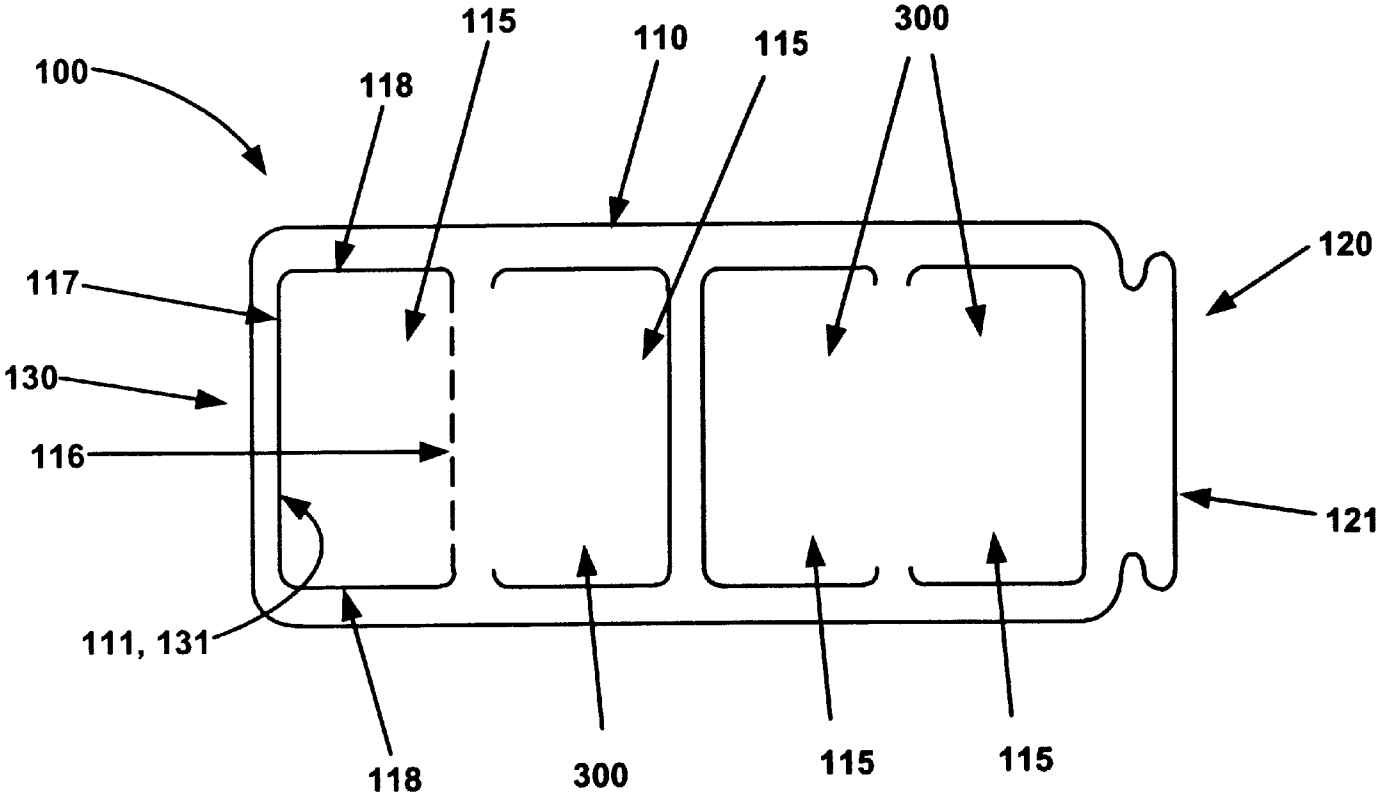
FIG. 1 is a representation of one of the embodiments of an unwrapped one-piece wrap around fin utilizing two vanes.
Figure 2:
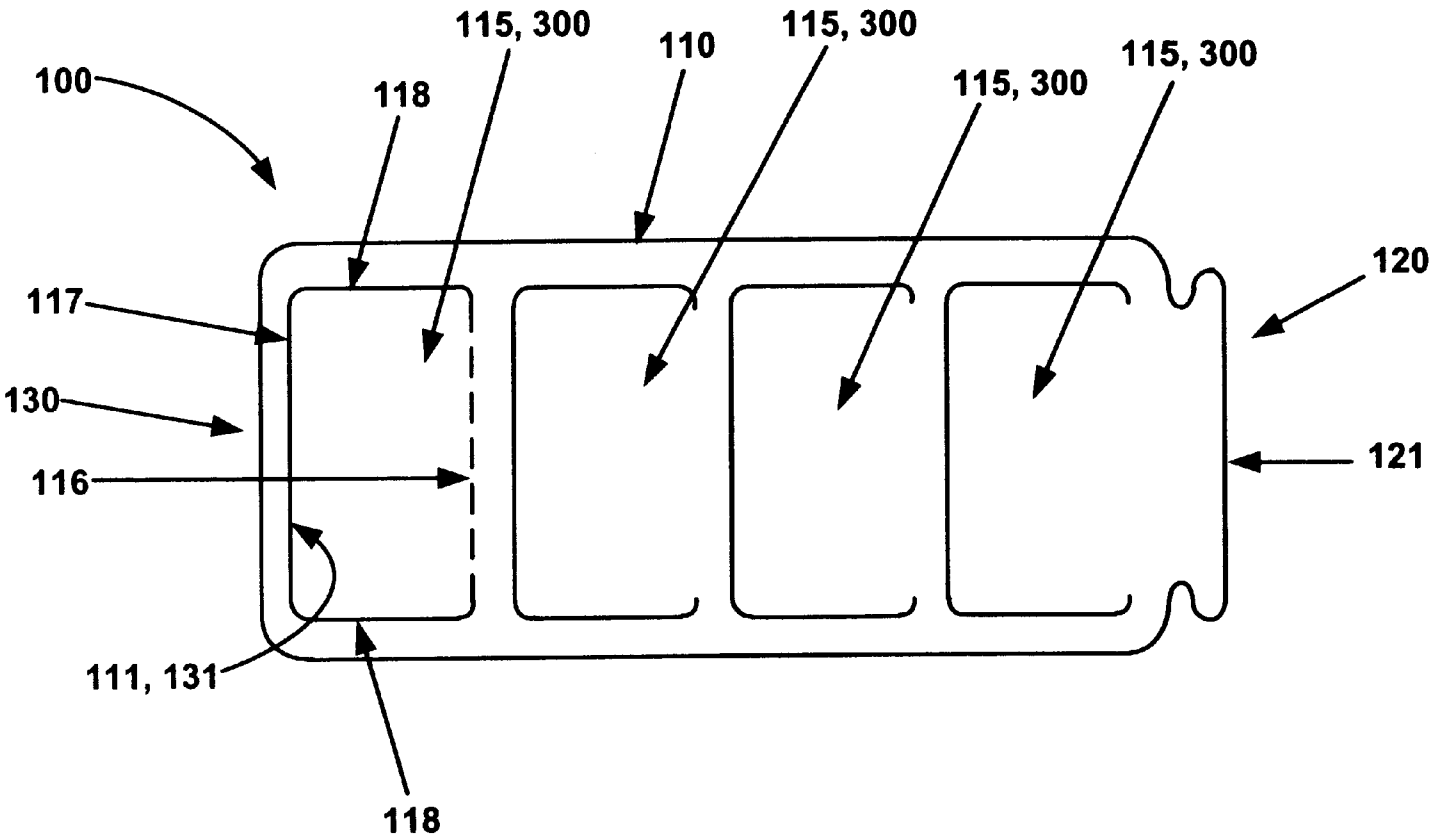
FIG. 2 is a representation of one of the embodiments of an unwrapped one-piece wrap around fin utilizing four vanes.

The preferred embodiments of the present invention are illustrated by way of example below and in FIGS. 1, 2, 3, 4, 5, 6 and 7. As seen in FIGS. 1 and 2, the one-piece wrap around fin 100 includes a main portion 110, a first end 120, and a second end 130. The first end 120 and the second end 130 cooperate such that the one-piece wrap around fin 100 is circumferentially mountable around a projectile, countermeasure or flare 200. As seen in FIGS. 1 and 2, the main portion 110 of the one-piece wrap around fin 100 may be substantially rectangular in shape with rounded corners.

In the discussion of the present invention, the invention will be discussed in a substantially cylindrical projectile environment, specifically a kinematic infrared countermeasure or kinematic flare environment; however, the invention can also be utilized for other vehicles or objects that require a fin or fins, such as, for example, but without limitation, submarines, ships, torpedoes, vehicles, space crafts, rockets, missiles, bullets, or any other items that require a fin or fins.

The main portion 110 has at least one flap 115. The at least one flap 115 may be substantially rectangular in shape and have rounded corners. A flap 115 can defined, but without limitation, as a section of the main portion 110 that is partially separated from the main body, or any control surface used primarily to increase the lift or drag on a projectile or aircraft. A flap 115 can also be, but without limitation, a shutter, a leaf, a brake, a rudder, a flaperon, an aileron, a blade, a foil, or the like. The flap 115 may have an attached edge 116, a separated edge 117, and two side edges 118. The attached edge 116 of the flap 115 is attached to the main portion 110, while the separated edge 117 is not attached to the main portion 110. The attached edge 116 and separated edge 117 can be on opposite sides of the flap 115 and substantially parallel. The two side edges 118 may be substantially parallel to each other, substantially perpendicular to the attached edge 116 and the separated edge 117, and not attached to the main portion 110.

Figure 3:
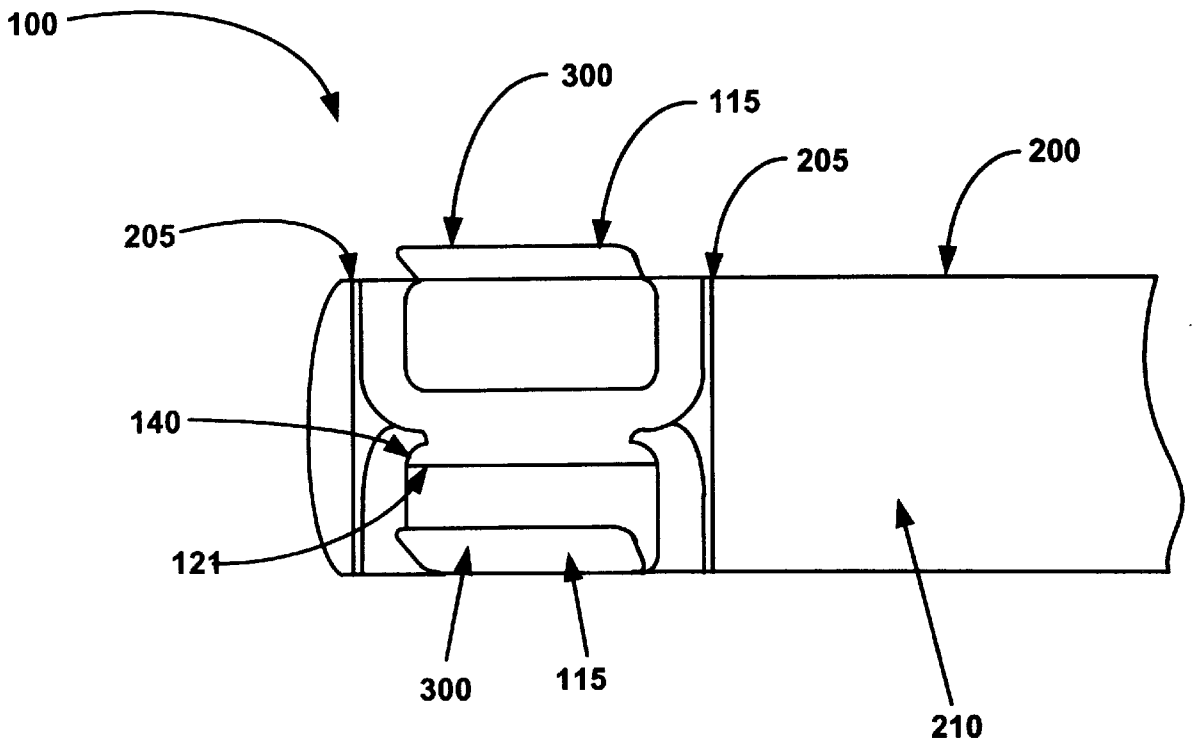
FIG. 3 is a side view of one of the embodiments of a wrapped one-piece wrap around fin utilizing two vanes.
Figure 4:
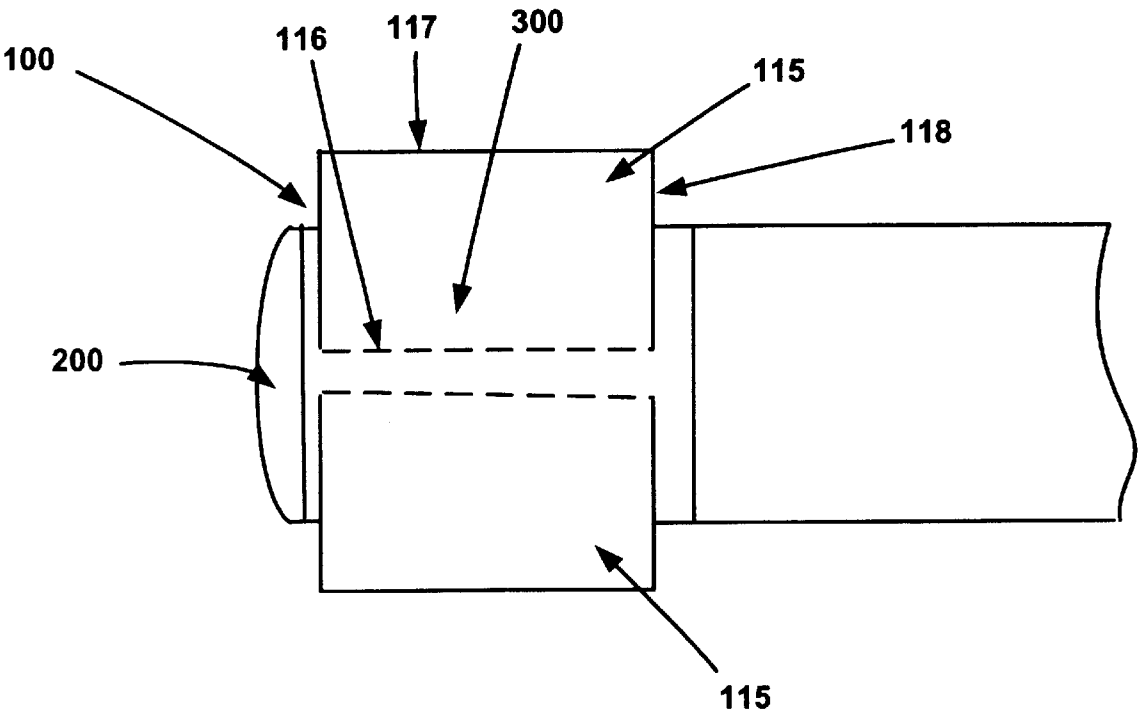
FIG. 4 is a top view of one of the embodiments of a wrapped one-piece wrap around fin utilizing two vanes.
Figure 5:
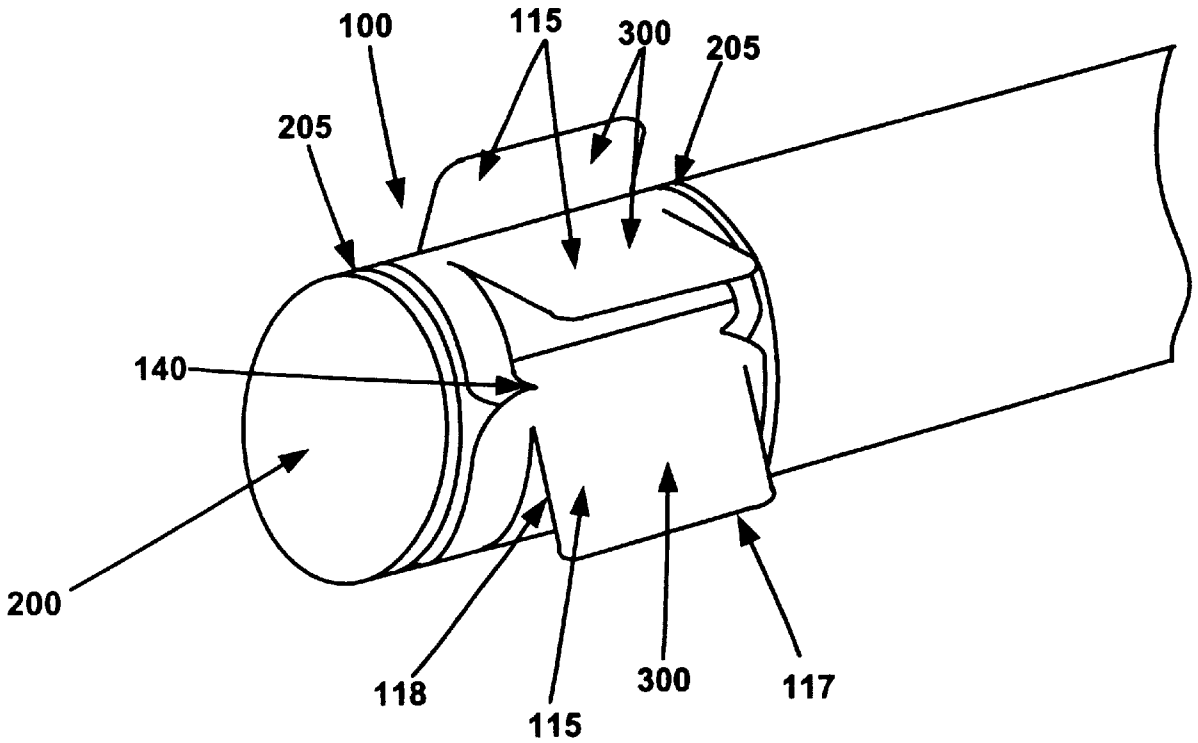
FIG. 5 is a perspective view of one of the embodiments of a wrapped one-piece wrap around fin utilizing four vanes.

As seen in FIGS. 1 and 2, the one-piece wrap around fin 100 may contain two vanes 300, four vanes 300, or any desired number of vanes. A vane 300 is typically defined, but without limitation, as any fixed or movable plane surface on the outside of the projectile. As seen in FIGS. 1, 3 and 4, the two-vane embodiment may contain two pairs of flaps 115. The two flaps 115 of each pair are juxtapositioned in manner such that the separated portions of the flap 115 or the separated edges 117 are oppositely disposed. As seen in FIG. 4, when the two-vane embodiment is installed on a projectile or flare 200 each pair of flaps 115 create a continuous plane or one vane 300 that is substantially tangential to the projectile or flare 200. As seen in FIGS. 2 and 5, in the four-vane embodiment, the four flaps 115 are juxtapositioned in a matter such that when installed on a projectile each flap 115 creates its own plane or vane 300. In the preferred embodiment of any multi-vane one-piece wrap around fin 100, the outer edge or separated edge 117 of every flap 115 is substantially parallel.

Figure 6:
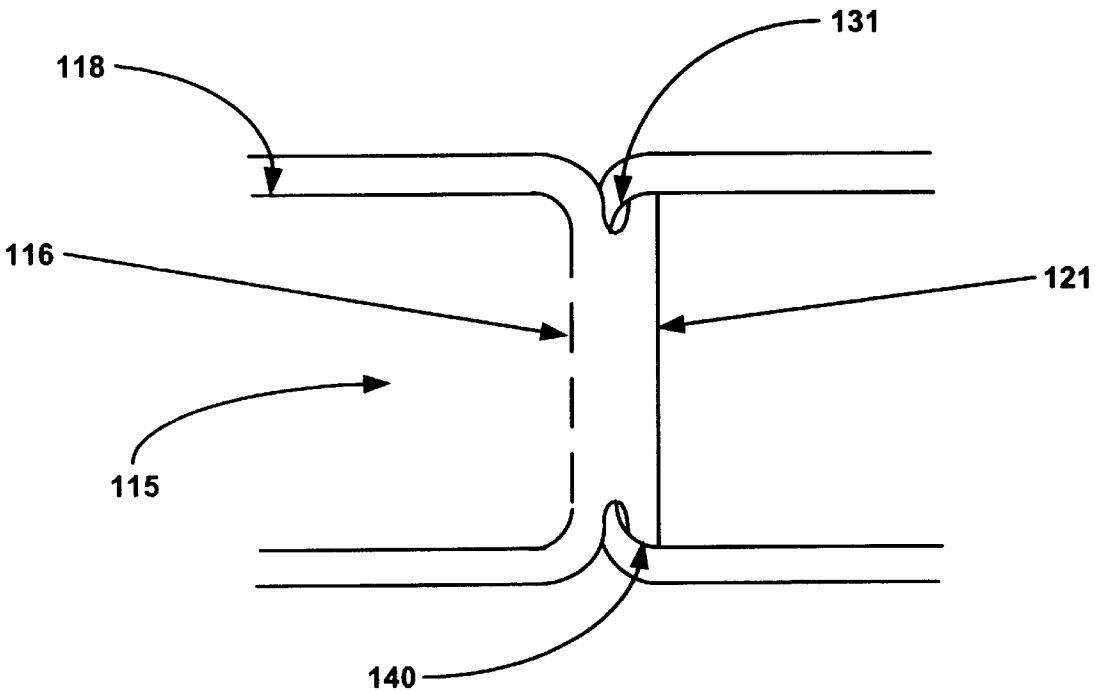
FIG. 6 is a representation of the outside view of the tab-slot joint.
Figure 7:
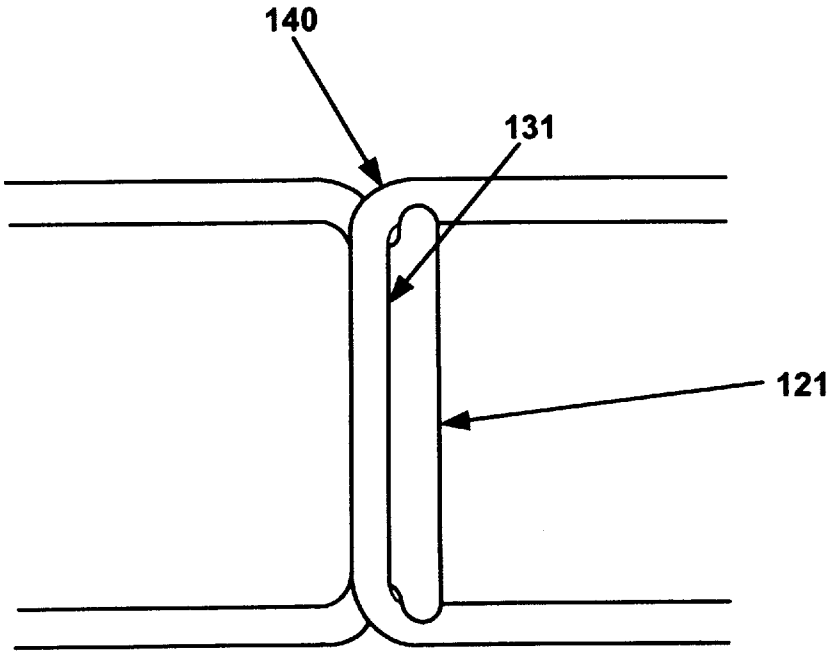
FIG. 7 is a representation of the inside view of the tab-slot joint.

In one of the embodiments of the invention, the first end 120 of the one-piece wrap around fin 100 may include a tab 121 while the second end 130 may include a slot 131. In one of the embodiments, as seen in FIG. 1, the slot 131 may be an inner main portion edge 111 that is adjacent to and the corresponding edge of the separated edge 117 of a flap 115. In operation, the one-piece wrap around fin 100 is overlaid or mounted on a projectile, countermeasure, flare 200 or any substantially cylindrical payload. The first end 120 and second end 130 are folded together in a hoop and the tab 121 is inserted into the slot 131 as seen in FIGS. 6 and 7. The tab 121 and slot 131 together creates a tab-slot joint 140. As seen in FIGS. 3 and 5, when the one-piece wrap around fin 100 is overlaid or mounted around the projectile or flare 200 the at least one flap 115 extends outward from the projectile.

As seen in FIGS. 3 and 5, the projectile, countermeasure, or flare 200 may include flanges 205 molded in the flare 200. The one-piece wrap around fin 100 is entrapped by the flanges 205 to ensure that the one-piece wrap around fin 100 cannot come off in the fore or aft direction. These flanges 205 also ensure that the one-piece wrap around fin 100 cannot come apart at the tab-slot joint 140. The flanges 205 may be included in a cylindrical payload housing 210 of the projectile or flare 200 that may be overlaid on the flare 200. The cylindrical payload housing 210 may be manufactured from plastic and/or injected molded plastic material.

The one-piece wrap around fin 100 may be manufactured from any material that has spring like or elastic characteristics. Spring steel is the preferred material. Steel is a tough elastic alloy of iron containing small quantities of carbon. Mild or soft steel contains less than 0.15% carbon, medium steel has 0.15% to 0.30% carbon, while hard steel contains more than 0.30% carbon. The preferred type of spring steel has about 0.69% to about 0.80% carbon, is oil tempered, is quenched in oil during manufacture, and is commonly referred to as 0.74 Carbon Oil Tempered Spring Steel. Tempering is typically defined as a process of reheating quench-hardened or normalized steel to a temperature below the transformation range and then cooling at any rate desired; the primary purpose of tempering is to impart a degree of plasticity or toughness to the steel to alleviate the brittleness of its martensite (a distinctive needlelike structure existing in steel as a transition stage in the transformation of austenite, which is a phase in certain steels, characterized as a solid solution, usually of carbon or iron carbide, in the gamma form of iron.) The preferred Rockwell Hardness for the one-piece wrap around fin 100 is in the range of about C44 to about C47. When utilizing spring steel the one-piece wrap around fin 100 may be stamped or cut and does not require any heat treatment to obtain spring tension to deploy.

When introducing elements of the present invention or the preferred embodiment(s) thereof, the articles "a," "an," "the," and "said" are intended to mean there are one or more of the elements. The terms "comprising," "including," and "having" are intended to be inclusive and mean that there may be additional elements other than the listed elements.

Although the present invention has been described in considerable detail with reference to certain preferred versions thereof, other versions are possible. Therefore, the spirit and scope of the appended claims should not be limited to the description of the preferred versions contained herein.

What is claimed is:

1. A one-piece wrap around fin for a projectile, the one-piece wrap around fin comprising:

(a) a main portion, the main portion comprising at least one flap;

(b) a first end; and (c) a second end, the first end and the second end cooperating such that the fin is circumferentially mountable around the projectile, wherein when the fin is circumferentially mounted around the projectile the at least one flap extends outward from the projectile, the first end comprising a tab and the second end comprising a slot, the slot corresponding to the tab.

2. The one-piece wrap around fin of claim 1, wherein the first end and the second end are located on opposite ends of the one-piece wrap around fin.

3. The one-piece wrap around fin of claim 2, wherein the one-piece wrap around fin is manufactured from spring steel.

4. The one-piece wrap around fin of claim 3, wherein the projectile is an aerodynamically stabilized kinematic infrared countermeasure.

5. A one-piece wrap around fin for an aerodynamically stabilized kinematic infrared countermeasure, the one-piece wrap around fin comprising:

(a) a main portion, the main portion comprising at least one flap;

(b) a first end, the first end comprising a tab; and (c) a second end, the second end comprising a slot, the slot corresponding to the tab, the first end and the second and located on opposite ends of the one-piece wrap around fin, the tab and the slot cooperating such that the one-piece wrap around fin is circumferentially mountable around the countermeasure, when the one-piece wrap around fin is mounted around the countermeasure the at least one flap extends outward from the countermeasure, the one-piece wrap round fin manufactured from spring steel.

6. The one-piece wrap around fin of claim 5, wherein the countermeasure comprising flanges, the flanges entrapping the one-piece wrap around fin on the countermeasure.

7. The one-piece wrap around fin of claim 6, wherein flap creating a vane.

8. The one-piece wrap around fin of claim 6, wherein there are 4 flaps which create two vanes.

9. The one-piece wrap around fin of claim 6, wherein the spring steel containing about 0.69% to about 0.80% carbon.

10. The one-piece wrap around fin of claim 9, wherein the spring steel is oil tempered.

11. The one-piece wrap around fin of claim 10, wherein the spring steel has a Rockwell Hardness in a range from about C44 to about C47.

12. The one-piece wrap around fin of claim 11, wherein the spring steel is quenched in oil during manufacture.

13. A one-piece wrap around fin for an aerodynamically stabilized kinematic infrared countermeasure, the one-piece wrap round fin comprising:

(a) a main portion, the main portion comprising at least one flap:

(b) a first end, the first end comprising a tub; and (c) a second end, the second end comprising a slot, the first end and the second end are located on opposite ends of the one-piece wrap around fin, the tab and the slot cooperating such that the one-piece wrap around fin is circumferentially mountable around the countermeasure, when the one-piece wrap around fin is mounted around the countermeasure the at least one flap extends outward from the countermeasure, the countermeasure comprising flanges, the flanges entrapping the one-piece wrap around fin on the countermeasure, the one-piece wrap around fin manufactured from spring steel, the spring steel containing about 0.69% to about 0.80% carbon, is oil tempered, quenched in oil during manufacture, and has a Rockwell Hardness in a range of about C44 to about C47.

14. The one-piece wrap around fin of claim 13, wherein there are 4 flaps, each flap creating a vane.

15. The one-piece wrap around fin of claim 13, wherein there are 4 flaps which create two vanes.

* * * * *

UNITED STATES PATENT AND TRADEMARK OFFICE

CERTIFICATE OF CORRECTION

PATENT NO. : 6,672,537 B1
DATED : January 6, 2004
INVENTOR(S) : Deckard et al.

It is certified that error appears in the above-identified patent and that said Letters Patent is hereby corrected as shown below:

Column 4,
Line 62, should read -- end located on opposite ends of the one-piece wrap --

Column 5,
Lines 6-7, should read -- 7. The one-piece wrap around fin of claim 6, wherein there are 4 flaps, each flap creating a vane. --

Column 6,
Line 1, should read -- (b) a first end, the first end comprising a tab; and --

Signed and Sealed this

Sixteenth Day of March, 2004

JON W. DUDAS
*Acting Director of the United States Patent and Trademark Office*